US011700482B2

(12) United States Patent
Chizhov

(10) Patent No.: US 11,700,482 B2
(45) Date of Patent: Jul. 11, 2023

(54) SPEAKER DEVICE

(71) Applicant: YANDEX EUROPE AG, Lucerne (CH)

(72) Inventor: Maksim Viktorovich Chizhov, Odessa (RU)

(73) Assignee: YANDEX EUROPE AG, Lucerne (CH)

( * ) Notice: Subject to any disclaimer, the term of this patent is extended or adjusted under 35 U.S.C. 154(b) by 0 days.

(21) Appl. No.: 17/583,132

(22) Filed: Jan. 24, 2022

(65) Prior Publication Data

US 2022/0312110 A1 Sep. 29, 2022

(30) Foreign Application Priority Data

Mar. 26, 2021 (RU) ..... RU2021108157

(51) Int. Cl.

| | |
|---|---|
| ***H04R 1/28*** | (2006.01) |
| ***H04R 1/34*** | (2006.01) |
| ***H04R 1/24*** | (2006.01) |
| ***G10K 9/13*** | (2006.01) |

(52) U.S. Cl.

CPC ..... *H04R 1/345* (2013.01); *G10K 9/13* (2013.01); *H04R 1/24* (2013.01); *H04R 1/2811* (2013.01)

(58) Field of Classification Search

CPC ..... H04R 1/28; H04R 1/2803; H04R 1/2807; H04R 1/2869

See application file for complete search history.

(56) References Cited

U.S. PATENT DOCUMENTS

| | | | | |
|---|---|---|---|---|
| 3,327,808 | A | 6/1967 | Shaper | |
| 3,329,235 | A | 7/1967 | Shaper | |
| 3,818,138 | A | 6/1974 | Sperrazza | |
| 9,706,306 | B1 | 7/2017 | List | |
| 9,838,789 | B2 | 12/2017 | Merz | |
| 10,368,182 | B2 | 7/2019 | Gurkin et al. | |
| 10,694,280 | B1 * | 6/2020 | Combest | H04R 1/2842 |
| 2012/0219171 | A1 * | 8/2012 | Velican | H04R 1/2842 381/345 |
| 2015/0071473 | A1 * | 3/2015 | Chick | H04R 1/20 381/337 |

(Continued)

FOREIGN PATENT DOCUMENTS

| | | | |
|---|---|---|---|
| EP | 183429 | A2 | 6/1986 |
| EP | 2577987 | B1 | 10/2018 |
| WO | 2007126705 | A2 | 11/2007 |

OTHER PUBLICATIONS

Russian Search Report dated Oct. 26, 2022 issued in respect of the counterpart Russian Patent Application No. RU 2021108157.

*Primary Examiner* — Suhan Ni
(74) *Attorney, Agent, or Firm* — BCF LLP

(57) ABSTRACT

A speaker device for reproducing sound within a predetermined audio spectrum is provided. The speaker device comprises: a housing including a top, a bottom, and a side surface; at least one speaker disposed within the housing, the at least one speaker including a speaker flange facing towards the bottom; a waveguide including at least a first surface defining at least one sound channel for conducting a given sound produced by the at least one speaker, and the at least one channel includes a first zone, a second zone, and a third zone sequentially defined along a length thereof to provide for sound reproduction from 100 Hz to 20000 Hz.

20 Claims, 5 Drawing Sheets

(56) References Cited

U.S. PATENT DOCUMENTS

| | | | | |
|---|---|---|---|---|
| 2020/0404414 | A1* | 12/2020 | Huang | H04R 1/2834 |
| 2021/0258681 | A1* | 8/2021 | Chyzhov | H04R 1/2803 |
| 2022/0201390 | A1* | 6/2022 | Deng | H04R 1/021 |

* cited by examiner

SPEAKER DEVICE

CROSS-REFERENCE

The present application claims priority to Russian Patent Application No. 2021108157, entitled "Speaker Device", filed Mar. 26, 2021, the entirety of which is incorporated herein by reference.

TECHNICAL FIELD

The present technology relates generally to loudspeakers and acoustic characteristics thereof, and more specifically to a speaker device.

BACKGROUND

Broadly speaking, a loudspeaker (also, referred to herein as a "speaker device") is a device including an enclosure and drive units capable of converting an electrical audio signal into a respective sound.

When manufacturing the loudspeaker, its quality may typically be assessed by certain acoustic characteristics indicative of user experience in respect of the sound produced thereby. Such acoustic characteristics may include, for example, consistency of a frequency response associated with the loudspeaker and its resonance frequencies. Generally speaking, the former is indicative of a capability of the loudspeaker to maintain constant amplitude of the audio signal within an operating frequency range of the loudspeaker. In the mean time, one of the resonance frequencies may be associated with a width of the operating frequency range of the loudspeaker defining a lower boundary thereof, as it may be experimentally demonstrated that, at a frequency lower than the resonance frequency, the amplitude may significantly drop (for example, by 12 dB per octave), which may cause distortions to the produced sound recognizable by the ear.

Typically, the operating frequency range of the loudspeaker may be defined by a plurality of drive units of the loudspeaker respectively configured to operate within predetermined frequency subranges, such as: a bass frequency subrange (from around 20 Hz to around 320 Hz), a midrange frequency subrange (from around 320 Hz to around 1280 Hz), and a treble frequency subrange (from around 1280 Hz to around 20400 Hz)—covering the sound range of the human hearing.

However, when reducing a size of the enclosure of the loudspeaker, for example, to improve the ergonomics thereof, only a single wide-range drive unit may be used. This may consequently cause high values of the resonance frequency associated with the loudspeaker—for example, around 200 to 250 Hz, thereby shortening the operating frequency range of the loudspeaker.

Smart speaker devices have been recently introduced on the market. The manufacturers of the smart speaker devices have been challenged with finding a balance between the size of the smart speaker device and acoustic quality of the sound produced by such smart speaker devices.

Certain prior art approaches have been proposed to tackle the above-identified technical problems.

European Patent No.: 2,577,987 issued on Oct. 17, 2018 and entitled "Loudspeaker Apparatus with Circumferential, Funnel-Like Sound Outlet Opening" discloses a loudspeaker device comprising at least one sound generating means, wherein in a direction of sound emission of the sound generating means an at least partially sound conducting channel is arranged, which is adapted to direct the sound generating means emerging sound along the course of the sound conducting channel that the sound a trained as a sound outlet opening second end of the sound-conducting channel exits in a defined by the sound outlet beam angle from the speaker device.

Another typical prior art approach to decreasing negative effects of the high values of the resonance frequency is using a passive radiator. However, this approach has proved ineffective as the passive emitter, to be effective, may require being several times bigger with respect to a size of the single drive unit of the loudspeaker, which does not correspond to the initial objective of reducing the size of the loudspeaker or the smart speaker device.

Yet another approach to tackling the present technical problem may be use of a conical diffusor. However, this approach may also not be effective for the compact implementation of the loudspeaker as for achieving desired effectiveness, a size of the conical diffusor and a distance thereof from the single drive unit should be significantly greater than a wavelength associated with an upper boundary of the operating frequency range of the loudspeaker, which, in turn, is associated with significant overall dimensions of such an implementation.

SUMMARY

The object of the present technology is to ameliorate at least some of the inconveniences present in the prior art.

Non-limiting embodiments of the present technology are directed to a loudspeaker including (1) a cylindrical bass reflex enclosure; (2) a drive unit oriented horizontally within the cylindrical bass reflex enclosure; and (3) a conical waveguide located at predetermined distance from the single drive unit.

More specifically, the cylindrical bass reflex enclosure including a ring-shaped bass reflex port allows improving the acoustic characteristics of the loudspeaker in the bass frequency subrange. This may be achieved, for example, (1) by optimizing geometry of an input and an output of the ring-shaped bass reflex port (such as by using respective flares), and (2) damping the ring-shaped bass reflex port by covering the output thereof by a sound transparent fabric. Such an implementation of the ring-shaped bass reflex port allows minimizing input power to the loudspeaker and a number of distortions within the bass frequency subrange, such as overtones caused by air flow turbulence.

Further, the conical waveguide forms three specific zones within the loudspeaker allowing for: (1) significant reduction of unwanted resonance effects in the midrange frequency subrange and the treble frequency subrange; (2) effective acoustic impedance matching within the operating frequency range of the loudspeaker; and (3) a diffraction phenomenon further allowing forming a spherical uniform sound field characterized, inter *alia*, in constant directivity associated with the loudspeaker.

According to the non-limiting embodiments of the present technology, such an implementation of the loudspeaker allows for high-quality sound production within the operating frequency range spanning, at least, from 100 Hz to 20000 Hz.

More specifically, in accordance with a first broad aspect of the present technology, there is provided a speaker device for reproducing sound within an audio spectrum including a low range, a middle range, and a high range. The speaker device comprising: a housing including a top, a bottom, and a side surface; at least one speaker disposed within the cylindrical housing, the at least one speaker including a speaker flange facing towards the bottom; a waveguide including at least a first surface defining at least one sound channel for conducting a given sound produced by the at least one speaker, wherein: the first surface is defined in the bottom of the housing and includes a conical protrusion having an apex facing towards the speaker flange, the apex of the conical protrusion and a center of the speaker flange being located on a common axis substantially perpendicular to the bottom of the housing, such that the at least one channel includes a first zone, a second zone, and a third zone sequentially defined along a length thereof, wherein: the first zone is defined at least by a first cross-sectional dimension of the at least one channel, along the side surface of the housing, between the apex of the conical protrusion and the center of the speaker flange, the first cross-sectional dimension having been determined such that resonance phenomena, within a frequency response to the given sound, at frequencies corresponding to the middle range and the high range are minimized; the second zone is defined at least by a second cross-sectional dimension of the at least one channel, along the side surface of the housing, the second cross-sectional dimension having been determined such that an acoustic resistance of the given sound therewithin is maximized; and the third zone is defined at least by a third cross-sectional dimension of the at least one channel, along the side surface of the housing, at an exit of the at least sound channel, the third cross-sectional dimension having been determined to correspond to a maximum wavelength value associated with the audio spectrum for producing a uniform sound field in a vicinity of the speaker device, within the audio spectrum.

In some implementations of the speaker device, the uniform sound field is characterized by consistency of the frequency response of the speaker device to the given sound in the vicinity of the speaker device within the audio spectrum.

In some implementations of the speaker device, the consistency of the frequency response of the speaker device is provided for at frequencies from around 100 Hz to around 20000 Hz of the audio spectrum.

In some implementations of the speaker device, the consistency of the frequency response has been provided for by iteratively altering at least one of the second cross-sectional dimension and the third cross-sectional dimension of the at least one channel for determining respective optimal values thereof.

In some implementations of the speaker device, the altering the at least one of the second cross-sectional dimension and the third cross-sectional dimension, at each iteration, is performed with a predetermined step, the predetermined step being selected from a predetermined step range from about 0.5 mm to about 1 mm.

In some implementations of the speaker device, the second cross-sectional dimension has been determined to be from about 2 mm to about 4 mm.

In some implementations of the speaker device, the third cross-sectional dimension has been determined to be from about 15 mm to about 20 mm.

In some implementations of the speaker device, the third zone is further defined by gradual extension of the at least one sound channel from the second cross-sectional dimension to the third cross-sectional dimension thereof.

In some implementations of the speaker device, the third zone is further configured for: amplifying an amplitude of the given sound at at least some frequencies of the high range of the audio spectrum; and attenuating the amplitude of the given sound at at least some frequencies of the low range and the middle range of the audio spectrum.

In some implementations of the speaker device, the amplifying is from about 15 dB to about 20 dB.

In some implementations of the speaker device, the first cross-sectional dimension is selected from a first predetermined distance range from about 2 mm to about 4 mm.

In some implementations of the speaker device, the speaker flange is configured to house a concave membrane of the speaker device.

In some implementations of the speaker device, the side surface of the housing further defines a bass reflex port, the bass reflex port being configured for minimizing one or more sound distortions to the given sound at frequencies corresponding to the low range of the audio spectrum.

In some implementations of the speaker device, the one or more sound distortions include overtones and non-linear sound distortions of the given sound at frequencies corresponding to the low range of the audio spectrum.

In some implementations of the speaker device, the bass reflex port is implemented as a Helmholtz resonator.

In some implementations of the speaker device, the bass reflex port comprises at least one flare.

In some implementations of the speaker device, the bass reflex port further comprises a damping cover.

In some implementations of the speaker device, the damping cover comprises using an acoustically transparent fabric.

In some implementations of the speaker device, the bass reflex port is configured for unloading sound pressure, caused by a given sound, off the speaker device at least at frequencies from about 150 Hz to about 200 Hz.

In some implementations of the speaker device, the audio spectrum comprises all of the low range, the middle range, and the high range.

In some implementations of the speaker device, the waveguide further includes a second surface protruding from the side surface at least partially over the first surface, and the second cross-sectional dimension and the third cross-sectional dimension of the at least one channel are defined as respective distances between the first surface and the second surface of the waveguide.

For purposes of this application, terms related to spatial orientation, such as forwardly, rearwardly, upwardly, downwardly, left, right, and the like, are as they would normally be understood by a user or operator of the device. Terms related to spatial orientation when describing or referring to components or sub-assemblies of the device, separately from the device should be understood as they would be understood when these components or sub-assemblies are mounted to the device.

Further, it should be expressly understood that the terms related to the spatial orientation listed above should be interpreted, in the context of the present specification, as depicted in the provided drawings.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
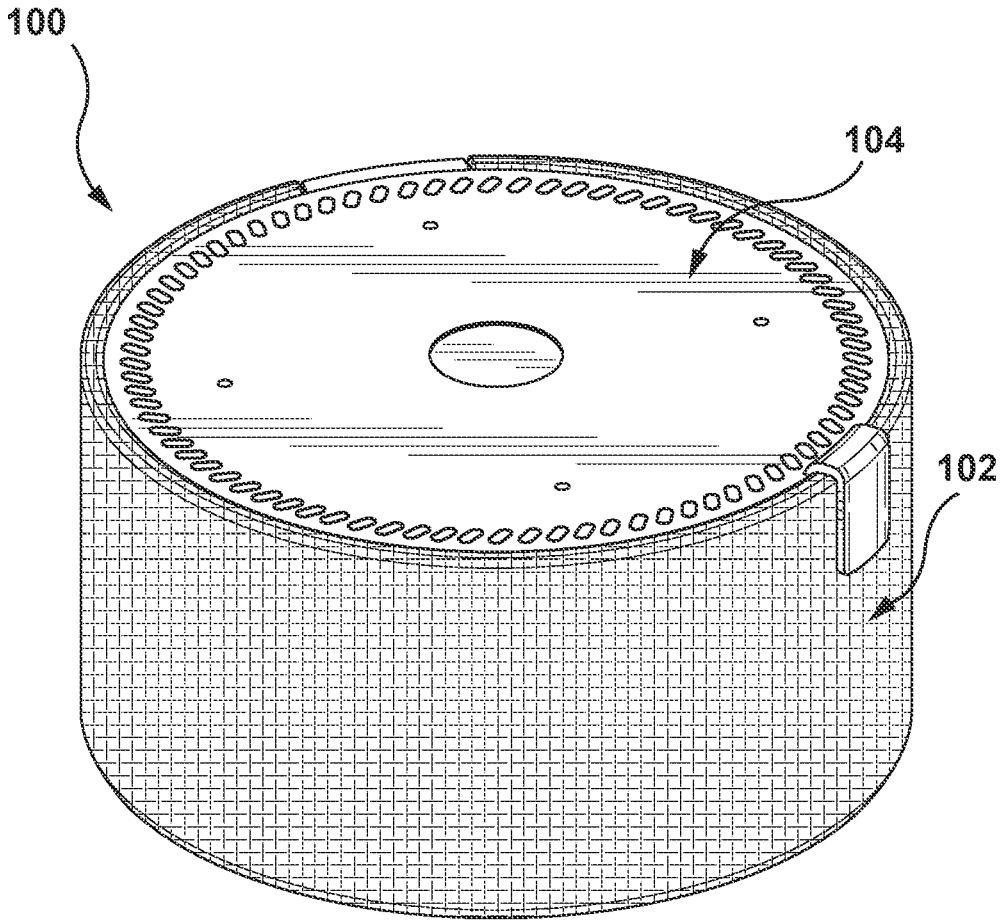
FIG. 1 is atop perspective view of a speaker device, in accordance with certain non-limiting embodiments of the present technology.

Referring initially to FIG. 1, there is depicted a speaker device 100, in accordance with certain non-limiting of the present technology. The speaker device 100 can be positioned by an operator (not depicted) thereof on a flat support surface, such as a desk (not depicted), for example. Broadly speaking, in some non-limiting embodiments of the present technology, the speaker device 100 can be configured to convert electrical signals into respective sounds within a predetermined audio spectrum. For example, the speaker device 100 can be configured to reproduce songs and/or other audio feeds, which the operator of the speaker device 100 wishes to hear. In additional non-limiting embodiments of the present technology, the speaker device 100 can be configured to reproduce the respective sounds in response to predetermined spoken utterances and/or haptic interactions of the operator of the speaker device 100.

In certain non-limiting embodiments of the present technology, the predetermined audio spectrum associated with the speaker device 100 may correspond to a range appreciable by a human ear. To that end, in these embodiments, the predetermined audio spectrum may cover a range of electromagnetic radiation having frequency between around 100 Hz and around 20000 Hz. In this regard, according to certain non-limiting embodiments of the present technology, the predetermined audio spectrum may include: (1) a low range from around 100 Hz to around 320 Hz (also referred to herein as a "bass frequency range"); (2) a middle frequency range from around 320 Hz to around 1280 Hz (also referred to herein as a "mid-frequency range"); and (3) a high range from around 1280 Hz to around 20400 Hz (also referred to herein as a "treble frequency range"). Further, each one of the low range, the middle range, and the high range may additionally be subdivided into a lower subrange, a middle subrange, and an upper subrange, which may become apparent to a person skilled in the art. By way of example, the low range may thus be represented as a combination of a low-bass subrange, a middle-bass subrange, and an upper-bass subrange. How the speaker device 100 is configured to reproduce a given sound within the predetermined audio spectrum will be described herein below.

Figure 2:
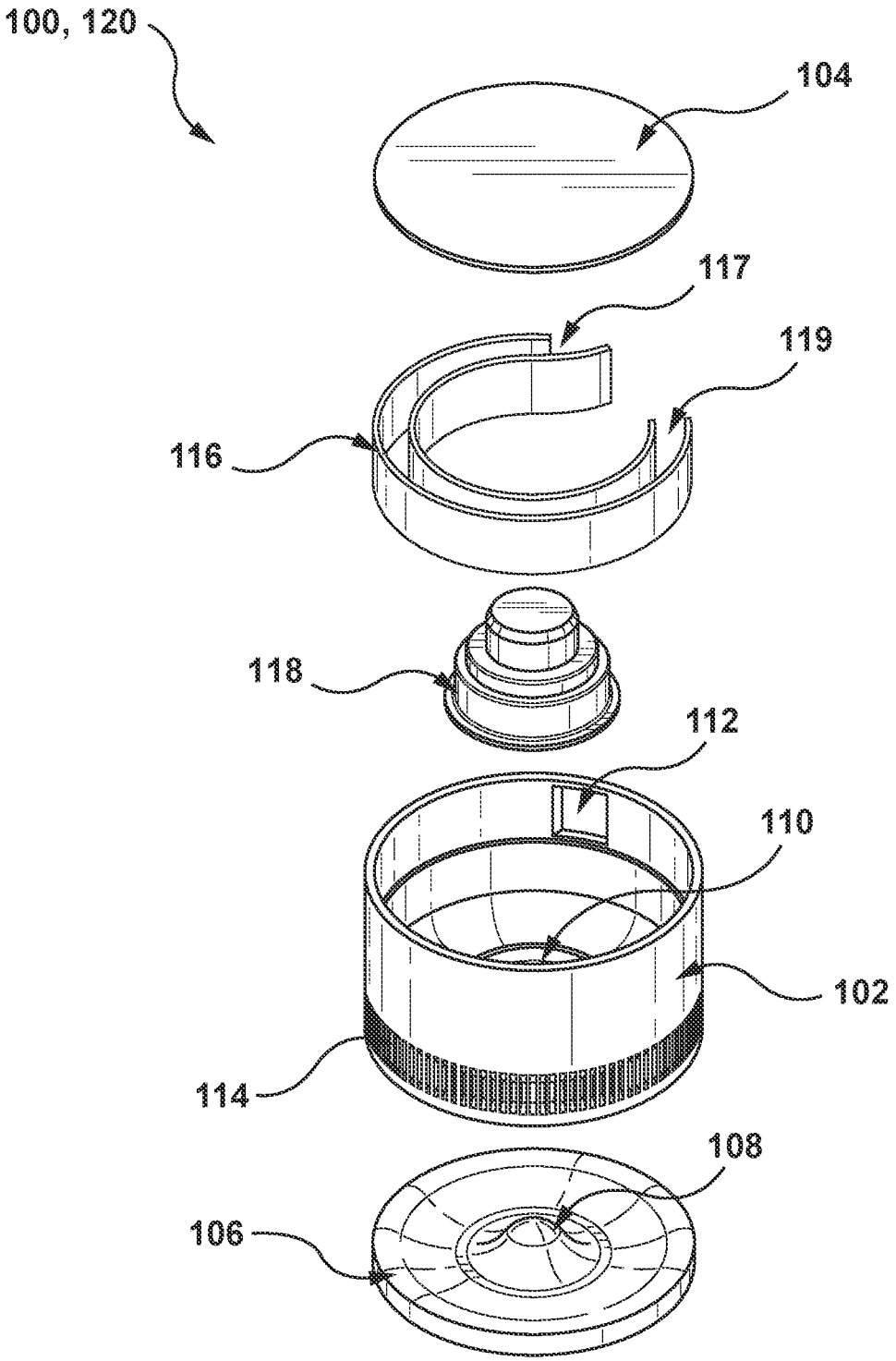
FIG. 2 is a partially exploded perspective view, taken from a top of the speaker device of FIG. 1 depicting an acoustic assembly housed therewithin, in accordance with certain non-limiting embodiments of the present technology.

In certain non-limiting embodiments of the present technology, the speaker device 100 can be configured to operate within the predetermined audio spectrum using a specifically configured acoustic assembly, such as an acoustic assembly 120 as depicted in FIG. 2, in accordance with certain non-limiting embodiments of the present technology, components of which will be described below.

With reference to FIGS. 1 and 2, the speaker device 100 includes a housing further including a side surface 102 configured for receiving a top assembly 104 and a bottom assembly 106.

In some non-limiting embodiments of the present technology, the housing of the speaker device 100 is a compact housing having its largest dimension not exceeding 100 mm, as an example.

Figure 4:
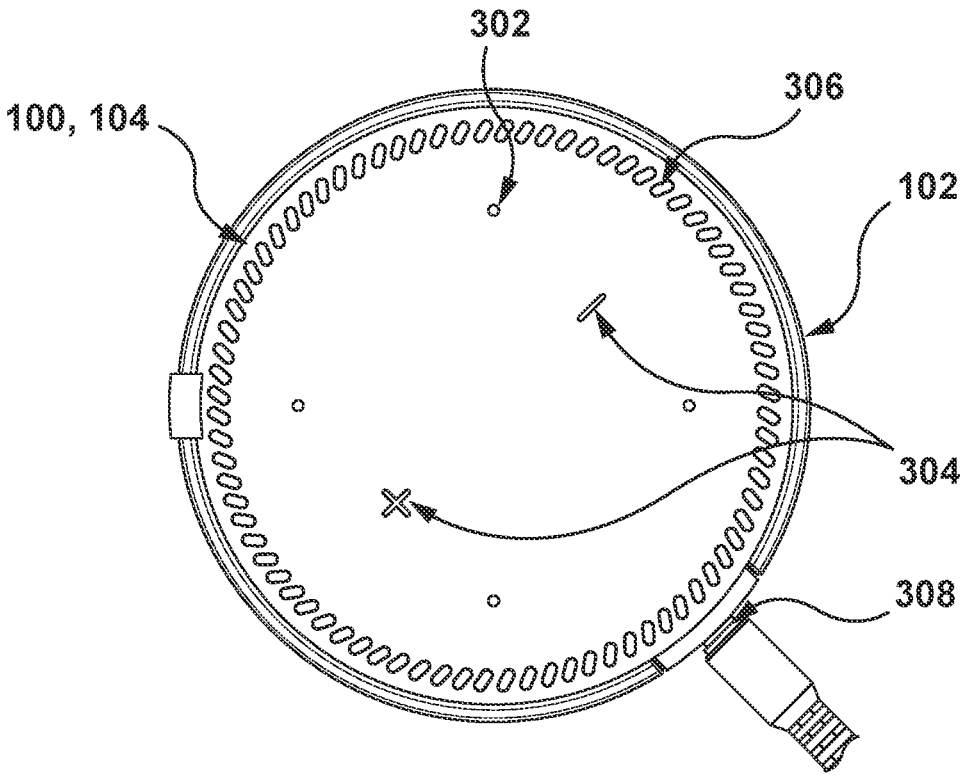
FIG. 4 is a top planar view of the speaker device of FIG. 1, in accordance with certain non-limiting embodiments of the present technology.

With reference to FIG. 4, broadly speaking, according to certain non-limiting embodiments of the present technology, the top assembly 104 can be configured for (i) receiving commands from the operator (not depicted) of the speaker device 100; and (ii) providing visual indications to the operator. To that end, in some non-limiting embodiments of the present technology, the top assembly 104 can include a plurality of various apertures, including, for example, LED apertures 302 configured for receiving respective LED light sources. Further, the top assembly 104 can further include buttons, such as sensor buttons 304 configured for modulating an amplitude of the given sound produced by the speaker device 100, as an example.

Finally, according to certain non-limiting embodiments of the present technology, the top assembly 104 can further define a plurality of acoustic openings 306 configured for conducting the given sound produced by the speaker device 100 within the outside environment thereof. The plurality of acoustic openings 306 may vary in shape and number suitable for providing smooth distribution of the sound waves associated with the given sound within the outside environment. By way of example, and not as a limitation, the plurality of acoustic openings 306 may be defined along an outline of the top assembly 104 in a circular fashion, as depicted in FIG. 4.

Figure 3:
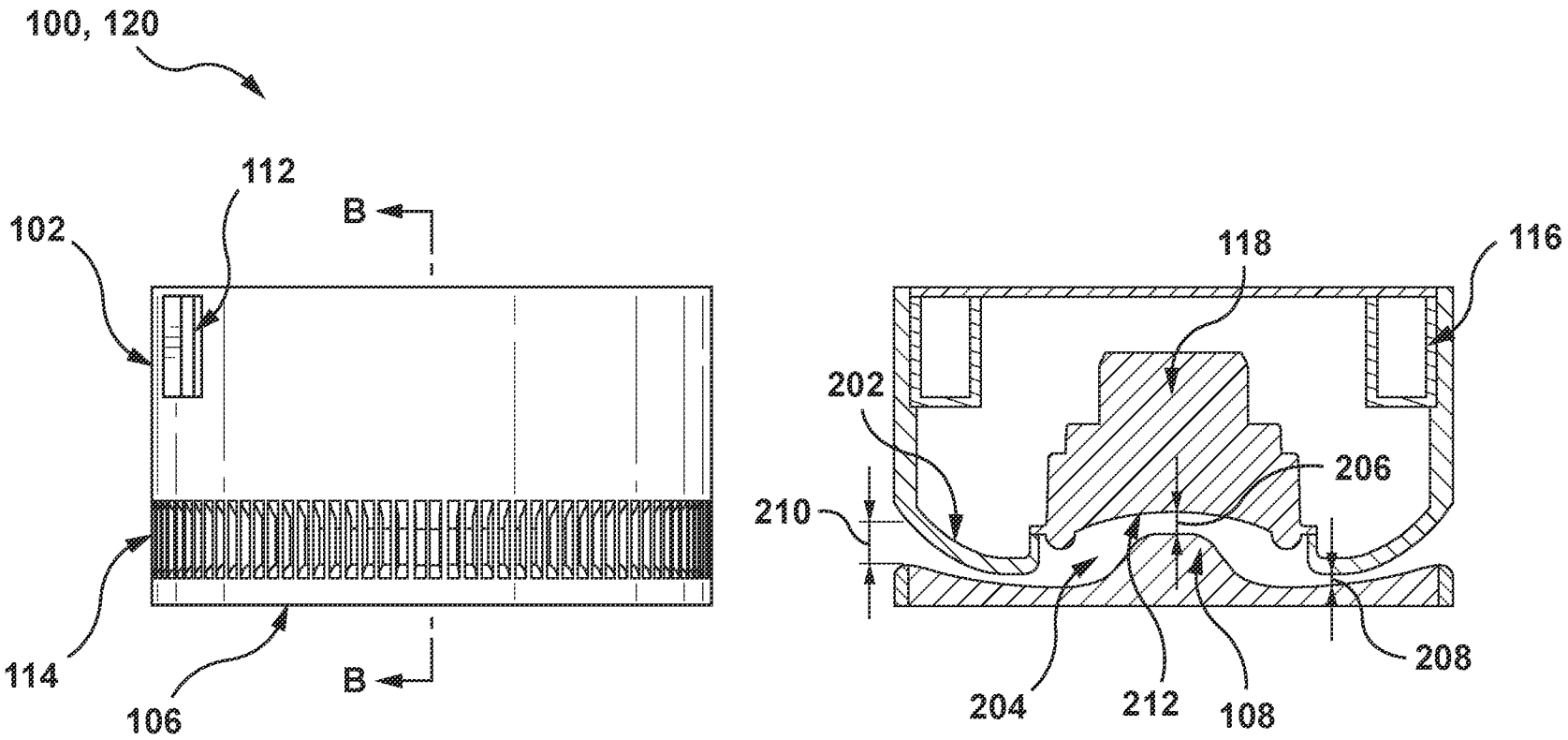
FIG. 3 is a side elevation view and a vertical cross-sectional view of the speaker device of FIG. 1, in accordance with certain non-limiting embodiments of the present technology.

Further, referring to FIGS. 2 and 3, according to certain non-limiting embodiments of the present technology, the side surface 102 can be of a cylindrical form configured for receiving the top assembly 104 and the bottom assembly 106, such that, when the speaker device 100 is assembled, the top assembly 104 and the bottom assembly 106 are flush levelled with a top and a bottom of the side surface 102, respectively.

According to certain non-limiting embodiments of the present technology, the side surface 102 can define a speaker grid 114. As depicted in FIG. 2, the speaker grid 114 can be defined around the side surface 102 in an annular form (however, other form factors are envisioned) parallel to one of the top assembly 104 and the bottom assembly 106. Further, the speaker grid 114 may be shifted vertically along the side surface 102 to match an output of a sound channel of the speaker device 100, as will be described below. As it may be appreciated, in some non-limiting embodiments of the present technology, the speaker grid 114 can be positioned, in the cross-section view depicted in FIG. 3, in front of an exit of a sound channel (such as at least one channel 204 depicted in FIG. 3) of the speaker device 100, thereby conducting the given sound produced thereby to a surrounding environment thereof, as will be described below.

Further, according to certain non-limiting embodiments of the present technology, the speaker device 100 can be implemented including a bass reflex enclosure. To that end, as depicted in FIGS. 2 and 3, the side surface 102 can define a bass reflex port 112 configured for coupling thereto a bass reflex tubing system 116 disposed within the side surface 102 of the acoustic assembly 120.

According to certain non-limiting embodiments of the present technology, the bass reflex tubing system 116 can be coupled to the top assembly 104, thereby forming a closed internal surface thereof. Further, a first edge 117 of the bass reflex port tubing system 116 can be coupled to the bass reflex port 112 of the speaker device 100; whereas a second edge 119 of the bass reflex tubing system 116 can be coupled to an internal surface of the side surface 102 of the speaker device 100. As such, in certain non-limiting embodiments of the present technology, the bass reflex tubing system 116 can be implemented as a Helmholtz resonator.

Further, in some non-limiting embodiments of the present technology, the bass reflex tubing system 116 may be damped for example, at the bass reflex port 112. In these embodiments, the damping may be implemented by covering the bass reflex port 112 with an acoustically transparent fabric (not depicted). Broadly speaking, the term "acoustically transparent", as used herein, relates to properties of the fabric indicative of penetrability thereof to sound waves going therethrough. In some non-limiting embodiments, any acoustic textile can be used.

Further, in some non-limiting embodiments of the present technology, the bass reflex port 112 can further include at least one flare (not depicted) affixed thereto at an outside of the speaker device 100. In these embodiments, the at least one flare (not depicted) may be configured for optimizing the geometry of the bass reflex tubing system 116 further allowing for minimizing effects of turbulization of air within the bass reflex tubing system 116 that could occur when at least one speaker 118 produces the give sound. In some non-limiting embodiments of the present technology, the at least one flare may be implemented having a substantially conical form expanding outwardly and having respective dimensions.

Accordingly, in certain non-limiting embodiments of the present technology, the bass reflex tubing system 116 can thus be configured for minimizing sound distortions, caused by the turbulization of the air within the bass reflex tubing system 116, of the given sound produced by the speaker device 100 at frequencies corresponding to the low range of the predetermined audio spectrum. In some non-limiting embodiments of the present technology, the bass reflex tubing system 116 can be configured for minimizing the sound distortions including at least one of overtones and nonlinear sound distortions.

In the context of the present specification the term "overtones" denotes undesired (unnecessary) sound waves having frequencies greater than a given fundamental one from the predetermined audio spectrum of the given sound produced by the at least one speaker 118, which may cause distortions thereto, and as a result, to the overall clarity and quality thereof.

Further, in the context of the present specification, the term "nonlinear sound distortions" denotes a phenomenon of a non-linear relationship between an input signal of the at least one speaker 118 and an output signal thereof. Such a phenomenon may occur, for example, when an electrical audio signal indicative of the given sound is supplied to the at least one speaker 118 and is further converted into the respective sound waves, which include additional (undesired) harmonics indicative of frequencies that were absent in the electrical audio signal.

By so doing, the bass reflex tubing system 116 can be configured for unloading sound pressure caused by the given sound produced by the speaker device 100. As a result, efficiency of the speaker device 100 at the frequencies corresponding to the low range can hence be increased. More specifically, in certain non-limiting embodiments of the present technology, the bass reflex tubing system 116 can thus be configured for the unloading the sound pressure off the speaker device 100 at frequencies from around 100 Hz to around 200 Hz. Accordingly, in certain non-limiting embodiments of the present technology, the bass reflex tubing system 116 can be configured for minimizing a resonance frequency of the speaker device 100, within the low range, to a level of around 100 Hz.

In the context of the present technology, the term "resonance frequency" of a given speaker device, such the speaker device 100, denotes a frequency level, below which an amplitude of the given sound produced by the speaker device 100, drops significantly at a predetermined speed. In some non-limiting embodiments of the present technology, in a frequency response diagram, such as a frequency response diagram 502 depicted in FIG. 5, of the speaker device 100, the amplitude of the given sound, below the resonance frequency, can drop at the predetermined speed equal to or greater than 3 dB per octave. Thus, in some implementations of the speaker device 100, the resonance frequency thereof can be said to define a lower boundary of the predetermined audio spectrum, within which the speaker device 100 is configured to produce the given sound.

Further, in some non-limiting embodiments of the present technology, the side surface 102 can define various electrical signal ports (not depicted). The electrical signal ports may allow connecting the speaker device 100 to an electrical power source and with other electronic devices (not depicted) using a wired connection. For example, referring to FIG. 4, the side surface 102 can define an audio port 308 allowing inputting an electrical audio signal (using an audio jack, as an example) indicative of the given sound to the speaker device 100 from an other electronic device.

According to certain non-limiting embodiments of the present technology, the side surface 102 can be configured for accommodating at least one speaker 118 (also referred to herein as a "speaker driver" or a "drive unit") of the acoustic assembly 120 for reproducing the given sound, received, for example, from the audio port 308, by the speaker device 100 within the predetermined audio spectrum. Generally speaking, the given sound is a combination of sound waves having various audio frequencies. The at least one speaker 118 can be accordingly configured to generate sound waves in the low range, the middle range, and the high range, as described above.

In some non-limiting embodiments of the present technology, the at least one speaker 118 is a single speaker disposed within the housing of the speaker device 100.

According to some non-limiting embodiments of the present technology, the at least one speaker 118 can include a concave membrane 212 (also referred to herein as a "speaker diaphragm") configured to convert the electrical audio signal provided to the speaker device 100 into the given sound. The concave membrane 212 may be produced out of a thin material, such as polypropylene, polyether ether ketone, polycarbonate, biaxially-oriented polyethylene terephthalate, and the like, for providing a desired level of sensitivity to the at least one speaker 118.

Finally, according to certain non-limiting embodiments of the present technology, the side surface 102, at a bottom thereof, can define a speaker aperture 110 for receiving a speaker flange of the at least one speaker 118 such that the speaker flange (not separately numbered) including the concave membrane 212 that faces towards the bottom assembly 106 of the speaker device 100 when it is assembled. As it can be appreciated from FIG. 2, in these embodiments, the speaker aperture 110 can be centered within the bottom (in the orientation of FIG. 2, not separately numbered) of the side surface 102 and can substantially follow the shape of the speaker flange of the at least one speaker 118.

Also, as depicted in FIGS. 2 and 3, in some non-limiting embodiments of the present technology, the bottom of the side surface 102 can be tapered downwardly to the bottom assembly 106, thereby defining a side protruding surface 202 oriented inwardly with respect to the side surface 102. Thus, the side protruding surface 202 can be defined at least partially over the bottom assembly 106 of the speaker device 100.

In additional non-limiting embodiments of the present technology, the side surface 102 may be configured to accommodate a plurality of additional hardware components (not depicted) of the speaker device 100, which has been omitted in the accompanying drawings for the sake of clarity and simplicity thereof as well as those of the present description. In this regard, the side surface 102 can additionally define respective mounting members for receiving each one of the plurality of additional hardware components (not depicted). For example, the plurality of additional hardware components of the speaker device 100 can include a processor (not depicted). When the speaker device 100 is assembled, the processor is communicatively coupled with the top assembly 104 (for example, by a wired connection), the at least one speaker 118, and each one of the various electrical signal ports, such as the audio port 308.

It should be noted that, in some embodiments of the present technology, the processor may comprise one or more processors and/or one or more microcontrollers configured to execute instructions and to carry out operations associated with the operation of the speaker device 100, which includes, without limitation, instructions associated with receiving commands from the operator of the speaker device 100, instructions associated with generating indications in response to receipt thereof, and the like. In various non-limiting embodiments of the present technology, the processor may be implemented as a single-chip, multiple chips and/or other electrical components including one or more integrated circuits and printed circuit boards. The processor may optionally contain a cache memory unit for temporary local storage of instructions, data, or additional computer information. By way of example, the processor may include one or more processors, or one or more controllers dedicated for certain processing tasks of the speaker device 100 or a single multi-functional processor or controller.

Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage.

Further, according to some non-limiting embodiments of the present technology, the plurality of additional hardware components (not depicted) of speaker device 100 may include a communication module (not depicted). Such communication module may be configured for implementing one of communication protocols (both wireless and wired) enabling the processor to be connected with other electronic devices or remote servers. Various examples of how the communication module may be implemented include, without being limited to, a Bluetooth™ communication module, a UART™ communication module, a Wi-Fi™ communication module, an LTE™ communication module, and the like.

According to the non-limiting embodiments of the present technology, communication between the processor and other ones of the plurality of additional hardware components, such as the communication module, as well as amongst each other, may be implemented by one or more internal and/or external buses (e.g. a PCI bus, universal serial bus, IEEE 1394 "Firewire" bus, SCSI bus, Serial-ATA bus, etc.), to which a respective one of the plurality of additional hardware components of the speaker device 100 is electronically coupled.

Further, according to certain non-limiting embodiments of the present technology, the bottom assembly 106 can define a conical protrusion 108 with its apex (not separately numbered) facing towards the speaker flange (not separately numbered) of the at least one speaker 118. In these embodiments, the apex of the conical protrusion 108 and a center of the speaker flange of the at least one speaker 118 can be located on a common vertical axis (not depicted), which can be substantially perpendicular to one of the top assembly 104 and the bottom assembly 106.

Although in FIG. 3 the conical protrusion 108 is depicted to have a form of a truncated cone, it should be expressly understood that, in other non-limiting embodiments of the present technology, that the conical protrusion 108 may have a form of a regular cone having a more explicit apex, as an example.

Thus, the side protruding surface 204 and an inner surface of the bottom assembly 106 can form a waveguide (not separately numbered) of the acoustic assembly 120 further defining at least one channel 204 of the speaker device 100 configured for conducting the given sound produced by the at least one speaker 118.

According to certain non-limiting embodiments of the present technology, the at least one channel 204, in a vertical cross-section thereof, can be structurally divided in at least three zones sequentially defined therealong: a first zone, a second zone, and a third zone, each one of which will be described immediately below.

With continued reference to FIG. 3, in some non-limiting embodiments of the present technology, the first zone can be defined at least by a first cross-sectional dimension 206 of the at least one channel 204. As it can be appreciated from FIG. 3, the first cross-sectional dimension 206 can be determined between the apex of the conical protrusion 108 and the center of the flange of the at least one speaker 118. In these embodiments, the first cross-sectional dimension 206 can be determined to minimize resonance phenomena at frequencies of the given sound corresponding to the middle range and the high range of the predetermined audio spectrum. As it may become apparent to the person skilled in the art, the term "a resonance phenomenon", as used herein, refers to a phenomenon of a significant increase of the amplitude of the given sound at respective frequency levels. For example, in the frequency response diagram 502 of the speaker device 100, a given resonance phenomenon can be defined as a peak of the amplitude of the given sound, at a respective frequency level, having a rise followed by a respective fall, at least one of which is equal to or greater than 6 dB per octave.

More specially, in some non-limiting embodiments of the present technology, the first zone can thus be configured for minimizing the resonance phenomena of the given sound at frequencies from around 500 Hz to around 20000 Hz. Thus, in specific non-limiting embodiments of the present technology, the first cross-sectional dimension 206 can be selected from a first predetermined distance range spanning from around 2 mm to around 4 mm. In some non-limiting embodiments, the first cross-sectional dimension 206 can be selected to be minimum possible for the overall dimension of the speaker device 100, while achieving the above-described function.

Further, according to certain non-limiting embodiments of the present technology, the second zone can be defined by a second cross-sectional dimension 208 of the at east one channel 204. As it can be appreciated from FIG. 3, the second zone can be characterized by a substantial narrowing of the at least one channel 204 after the first zone. In certain non-limiting embodiments of the present technology, the second zone can thus be defined as a "slit" within the at least one channel 204.

In some non-limiting embodiments of the present technology, the second zone can thus be configured for providing maximum values of acoustic resistance to the given sound conducted thereto from the first zone. Accordingly, in these embodiments, the second zone can be configured for controlling an input of the given sound therefrom to the third zone.

According to certain non-limiting embodiments of the present technology, the second cross-sectional dimension 208 can be selected from a second predetermined distance range from around 2 mm to around 4 mm.

Finally, in certain non-limiting embodiments of the present technology, the third zone can be defined by a third cross-sectional dimension 210. In other words, as it can be appreciated from FIG. 3, the third zone can be defined by a gradual extension of the at least one channel 204 from the second cross-sectional dimension 208 to the third cross-sectional dimension 210 at an exit of the at least one channel 204, thereby further defining a trumpet structure of the speaker device 100.

Thus, according to certain non-limiting embodiments of the present technology, the third zone can be configured for amplifying the amplitude of the given sound produced, by the at least one speaker 118, at at least some frequencies corresponding to the high range of the predetermined audio spectrum. In these embodiments, the amplifying can be from around 15 dB to around 20 dB, as an example.

Further, the third zone can be configured for attenuating the amplitude of the given sound at at least other frequencies corresponding to the low range and the middle range of the predetermined audio spectrum. As it may become apparent, in these embodiments, the attenuating can be performed by virtue of a diffraction phenomenon occurred within the third zone and allowing the sound waves of the given sound to go around the housing of the speaker device 100.

Thus, the third zone can be configured for providing a uniform sound field around the speaker device 100. In accordance with certain non-limiting embodiments of the present technology, the uniform sound field can be defined as a sound field produced by the given sound, within which, at a predetermined distance from the speaker device 100 within the vicinity thereof, the frequency response to the given sound is substantially consistent, that is, a variation of the amplitude of the given sound, at each and every frequency level within the predetermined audio spectrum does not exceed 3 dB. In some non-limiting embodiments of the present technology, the uniform sound filed can have a spherical profile. Such configuration of the uniform sound field hence produced around the speaker device 100 may allow providing a more realistic reproduction of the given sound to a user of the speaker device 100.

In some non-limiting embodiments of the present technology, the third cross-sectional dimension 210 can be determined based on a wavelength value corresponding to an upper boundary of the predetermined audio spectrum associated with the speaker device 100. Thus, in specific non-limiting embodiments of the present technology, the third cross-sectional dimension 210 can be selected from a third predetermined distance range from around 15 mm to around 20 mm.

According to certain non-limiting embodiments of the present technology, a respective optimal value of each one of the first cross-sectional dimension 206, the second cross-sectional dimension 208, and the third cross-sectional dimension 210, within a respective one of the first predetermined distance range, the second predetermined distance range, and the third predetermined distance range, can be determined by iteratively altering at least one thereof, such that the consistency of the frequency response of the speaker device 100 to the given sound, within the predetermined audio spectrum, is maximized.

In some non-limiting embodiments of the present technology, the altering can be performed using a predetermined step, which can be from around 0.5 mm to around 1 mm, as an example. Further, the altering, at each iteration, may be followed by producing models of the speaker device 100, out of, for example, plastic and/or modelling clay, for verifying at least some of acoustic parameters of the speaker device 100. In certain non-limiting embodiments of the present technology, the at least some acoustic parameters may include a span of the predetermined audio spectrum and the consistency of the frequency response diagram therewithin. Thus, overall geometry of the at least one channel 204 can be defined within the speaker device 100.

Figure 5:
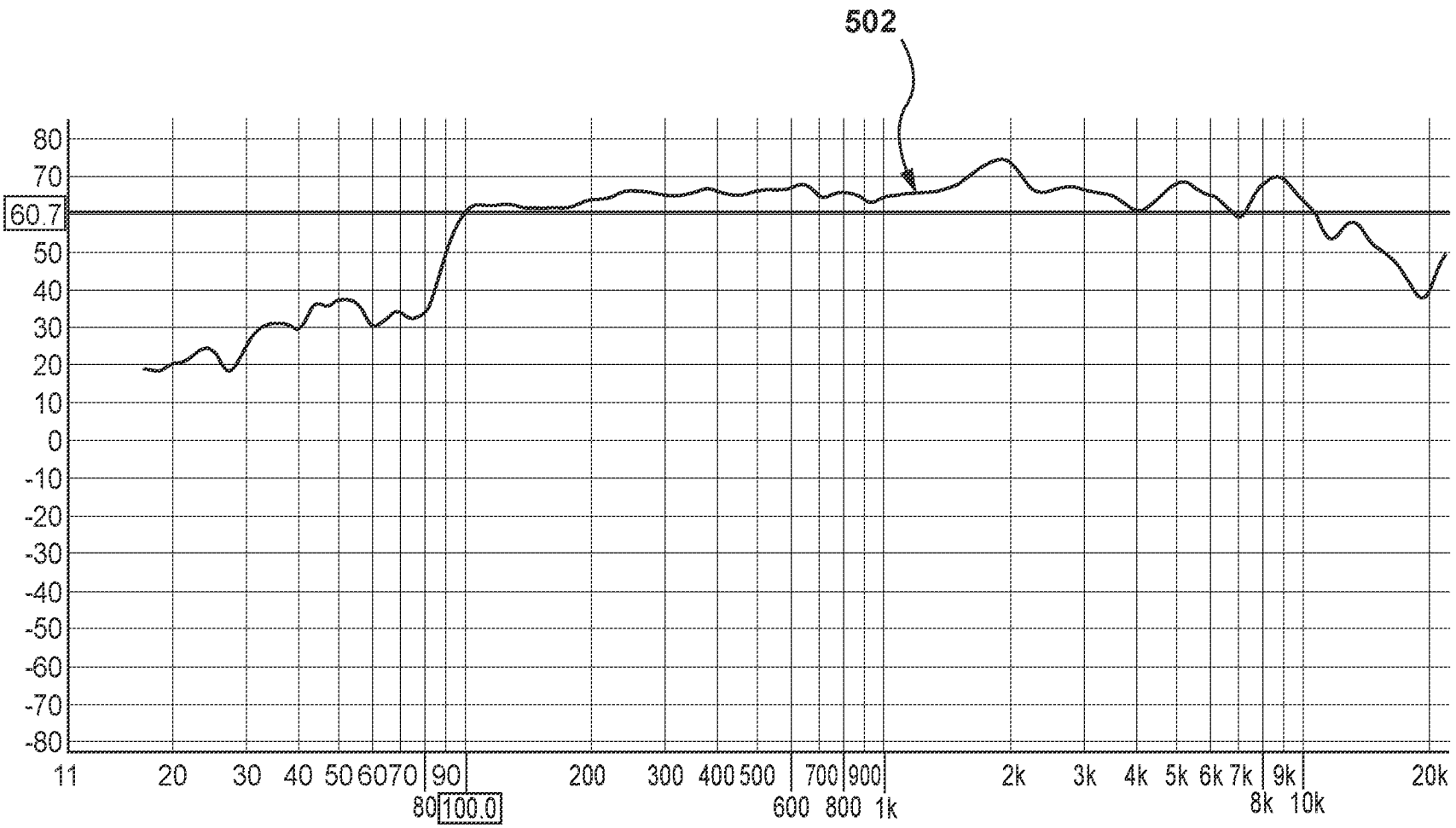
FIG. 5 depicts an example of a diagram of a frequency response to a given sound produced by the speaker device of FIG. 1, in accordance with certain non-limiting embodiments of the present technology.

With reference to FIG. 5, there is depicted an example of the frequency response diagram 502 to the given sound produced by the speaker device 100, in accordance with certain non-limiting embodiments of the present technology.

As it can be appreciated, the frequency response diagram 502 is representative of substantially constant amplitude values, that is, around 60 dB, as an example, within frequency levels of around 100 Hz and around 20000 Hz. Further, the frequency response diagram 502 does not include any resonance phenomena representative of respective rises and falls, within the frequency response diagram 502, greater than 6 dB per octave, which can be indicative of a smoother distribution of the given sound in the outside environment of the speaker device 100.

Thus, certain non-limiting embodiments of the present technology are directed to a speaker device enclosed within a compact housing and including a single speaker—such as the speaker device 100, whose frequency response is substantially consistent within the predetermined audio spectrum from around 100 Hz to around 20000 Hz.

Modifications and improvements to the above-described implementations of the present technology may become apparent to the person skilled in the art. The foregoing description is intended to be exemplary rather than limiting. The scope of the present technology is therefore intended to be limited solely by the scope of the appended claims.

What is claimed is:

1. A speaker device for reproducing sound within an audio spectrum including a low range, a middle range, and a high range, the speaker device comprising:

a housing including a top, a bottom, and a side surface;

at least one speaker disposed within the housing, the at least one speaker including a speaker flange facing towards the bottom;

a waveguide including at least a first surface defining at least one sound channel for conducting a given sound produced by the at least one speaker, wherein:

the first surface is defined in the bottom of the housing and includes a conical protrusion having an apex facing towards the speaker flange, the apex of the conical protrusion and a center of the speaker flange being located on a common axis substantially perpendicular to the bottom of the housing, such that the at least one channel includes a first zone, a second zone, and a third zone sequentially defined along a length thereof, wherein:

the first zone is defined at least by a first cross-sectional dimension of the at least one channel, along the side surface of the housing, between the apex of the conical protrusion and the center of the speaker flange, the first cross-sectional dimension having been determined such that resonance phenomena, within a frequency response to the given sound, at frequencies corresponding to the middle range and the high range are minimized;

the second zone is defined at least by a second cross-sectional dimension of the at least one channel, along the side surface of the housing, the second cross-sectional dimension having been determined such that an acoustic resistance of the given sound therewithin is maximized; and the third zone is defined at least by a third cross-sectional dimension of the at least one channel, along the side surface of the housing, at an exit of the at least sound channel, the third cross-sectional dimension having been determined to correspond to a maximum wavelength value associated with the audio spectrum for producing a uniform sound field in a vicinity of the speaker device, within the audio spectrum.

2. The speaker device of claim 1, wherein the uniform sound field is characterized by consistency of the frequency response of the speaker device to the given sound in the vicinity of the speaker device within the audio spectrum.

3. The speaker device of claim 2, wherein the consistency of the frequency response of the speaker device is provided for at frequencies from around 100 Hz to around 20000 Hz of the audio spectrum.

4. The speaker device of claim 3, wherein the consistency of the frequency response has been provided for by iteratively altering at least one of the second cross-sectional dimension and the third cross-sectional dimension of the at least one channel for determining respective optimal values thereof.

5. The speaker device of claim 4, wherein the altering the at least one of the second cross-sectional dimension and the third cross-sectional dimension, at each iteration, is performed with a predetermined step, the predetermined step being selected from a predetermined step range from about 0.5 mm to about 1 mm.

6. The speaker device of claim 4, wherein the second cross-sectional dimension has been determined to be from about 2 mm to about 4 mm.

7. The speaker device of claim 4, wherein the third cross-sectional dimension has been determined to be from about 15 mm to about 20 mm.

8. The speaker device of claim 1, wherein the third zone is further defined by gradual extension of the at least one sound channel from the second cross-sectional dimension to the third cross-sectional dimension thereof.

9. The speaker device of claim 8, wherein the third zone is further configured for:

amplifying an amplitude of the given sound at at least some frequencies of the high range of the audio spectrum; and attenuating the amplitude of the given sound at at least some frequencies of the low range and the middle range of the audio spectrum.

10. The speaker device of claim 9, wherein the amplifying is from about 15 dB to about 20 dB.

11. The speaker device of claim 1, wherein the first cross-sectional dimension is selected from a first predetermined distance range from about 2 mm to about 4 mm.

12. The speaker device of claim 1, wherein the speaker flange is configured to house a concave membrane of the speaker device.

13. The speaker device of claim 1, wherein the side surface of the housing further defines a bass reflex port, the bass reflex port being configured for minimizing one or more sound distortions to the given sound at frequencies corresponding to the low range of the audio spectrum.

14. The speaker device of claim 13, wherein the one or more sound distortions include overtones and non-linear sound distortions of the given sound at frequencies corresponding to the low range of the audio spectrum.

15. The speaker device of claim 13, wherein the bass reflex port is implemented as a Helmholtz resonator.

16. The speaker device of claim 13, wherein the bass reflex port comprises at least one flare.

17. The speaker device of claim 13, wherein the bass reflex port further comprises a damping cover.

18. The speaker device of claim 17, wherein the damping cover comprises using an acoustically transparent fabric.

19. The speaker device of claim 18, wherein the bass reflex port is configured for unloading sound pressure, caused by a given sound, off the speaker device at least at frequencies from about 150 Hz to about 200 Hz.

20. The speaker device of claim 1, wherein the waveguide further includes a second surface protruding from the side surface at least partially over the first surface, and the second cross-sectional dimension and the third cross-sectional dimension of the at least one channel are defined as respective distances between the first surface and the second surface of the waveguide.

* * * * *